US006314740B1

(12) United States Patent
De Blok et al.

(10) Patent No.: US 6,314,740 B1
(45) Date of Patent: Nov. 13, 2001

(54) THERMO-ACOUSTIC SYSTEM

(75) Inventors: Cornelis Maria De Blok, Melkwagaan 86, NL-2394 NG, Hazerswoude Rijndijk (NL); Nicolaas Adrianus Hendrikus Jozef Van Rijt, Zoeterwoude (NL)

(73) Assignee: Cornelis Maria De Blok, Hazerswoude (NL)

( * ) Notice: Subject to any disclaimer, the term of this patent is extended or adjusted under 35 U.S.C. 154(b) by 0 days.

(21) Appl. No.: 09/529,738

(22) PCT Filed: Sep. 8, 1998

(86) PCT No.: PCT/NL98/00515

§ 371 Date: Apr. 19, 2000

§ 102(e) Date: Apr. 19, 2000

(87) PCT Pub. No.: WO99/20957

PCT Pub. Date: Apr. 29, 1999

(30) Foreign Application Priority Data

Oct. 20, 1997 (NL) ..... 1007316

(51) Int. Cl.[7] ..... F25B 9/00

(52) U.S. Cl. ..... 62/6; 62/467

(58) Field of Search ..... 62/6, 467

(56) References Cited

U.S. PATENT DOCUMENTS

| | | | |
|---|---|---|---|
| 4,584,840 | 4/1986 | Baumann | 62/6 |
| 4,953,366 | 9/1990 | Swift et al. | 62/467 |
| 5,269,147 | 12/1993 | Ishizaki et al. | 62/6 |
| 5,295,355 | 3/1994 | Zhou et al. | 62/6 |
| 5,339,640 | 8/1994 | Reinke | 62/6 |
| 5,701,743 | 12/1997 | Hagiwara et al. | 62/6 |

FOREIGN PATENT DOCUMENTS 0 614 059 10/1995 (EP) .

*Primary Examiner*—Ronald Capossela
(74) *Attorney, Agent, or Firm*—Young & Thompson

(57) ABSTRACT

A regenerative thermo-acoustic energy converter includes a regenerator assembly located within an acoustic resonator room filled with gas, the regenerator assembly includes a regenerator located between a cold heat exchanger and a warm heat exchanger and a non-dissipative bypass circuit filled with gas connected across the regenerator assembly.

8 Claims, 2 Drawing Sheets

THERMO-ACOUSTIC SYSTEM

BACKGROUND OF THE INVENTION

Figure 1:
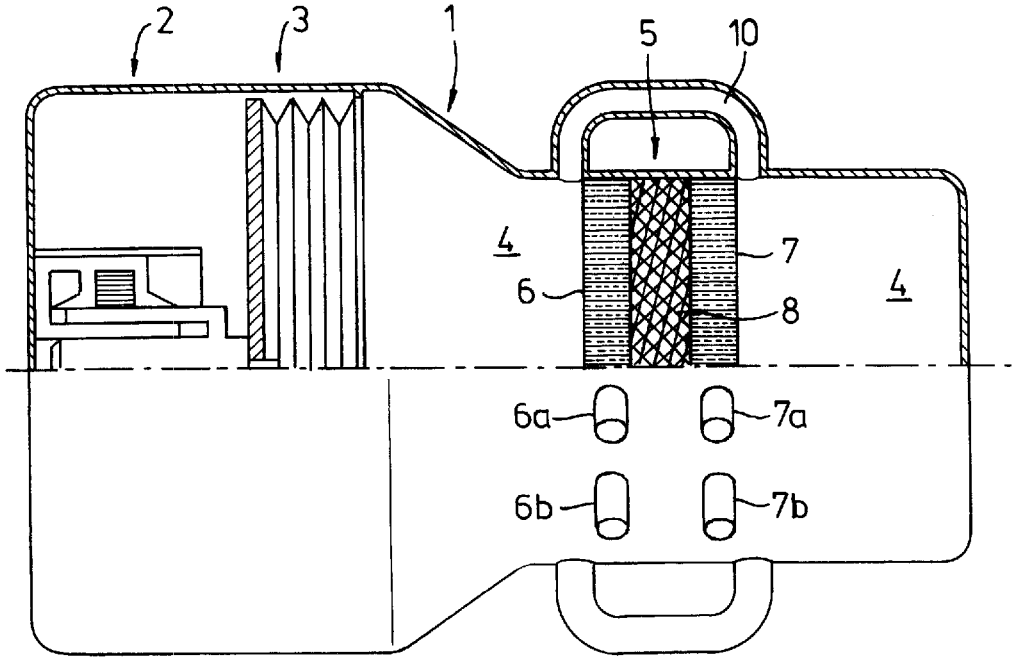

The invention relates to a regenerative thermoacoustic energy converter (TAEC), comprising an acoustic or mechanical-acoustic resonator circuit and a regenerator clamped between two heat exchangers.

Generally, a TAEC is a closed system in which in a thermodynamic circle process heat and acoustic energy, i.e. gas pressure oscillations, are transformed into each other. TAECs have a number of properties, which make them very suitable as heat pump, e.g. for refrigeration or heating, or as engine for driving pumps or generating electrical power. The number of moving parts in systems that are based on TAEC is limited and in principle no lubrication is needed. The construction is simple and offers a large freedom of implementation allowing the manufacturing and maintenance costs to be low. TAECs are environmentally friendly: instead of poisonous or ozone layer damaging substances, air or a noble gas can be used as the heat transfer medium. The temperature range of operation is large, thus allowing a large number of applications. Owing to the closed system, the external noise production is low; besides, the frequency spectrum is limited, so that, if necessary, adequate measures can be taken to minimise noise nuisance and vibrations.

A regenerative TAEC comprises an acoustic or acoustic-mechanical resonance circuit, in which a gas is present, as well as two heat exchangers, on both sides of a "regenerator" of a pourous material with good heat exchange properties. Assuming that the gas, having a certain temperature, is already in oscillation, heat is moved, under the influence of the acoustic wave, from the one heat exchanger, the entrance heat exchanger, to the other, the exit heat exchanger.

A TAEC can be used as a heat pump or as an engine. In the former case mechanical energy is added, by which the gas is brought into oscillation by means of e.g. a membrane, bellows or a free piston construction; by means of the oscillating gas heat is then "pumped" from the one heat exchanger to the other. In the latter case, as an engine, heat is supplied to the one heat exchanger and heat is drained at the other, whereby oscillation of the gas column is kept up; the gas movement can be coupled out as useful energy through the membrane. Said heat pump can also be driven directly without intervention of a membrane and E/M converter by said engine, by which a heat pumping system driven by heat comes about without any moving parts at all. From the patents referred to hereafter, TAECs are known as "pulse tubes", characterized by a so-called thermo-acoustic stack with a limited heat exchange and heat exchangers with a length greater than or equal to the local extension amplitude of the gas. In order to enlarge the refrigerating capacity, according to said patent, the pulse tube is provided with one or more "orifices", exit openings or bypasses of small diameter, connected to a buffer. As a consequence of such a controllable leak", the phase shift between gas pressure and velocity at the location of the stack is reduced and the impedance is lowered, thus increasing the heat pumping capacity. In fact, there is question of an RC network. True enough the capacity is increased by such an RC network, but because of energy dissipation in the resistive component of the network (orifice), the net efficiency is negatively affected.

From patent applications referred to hereafter regenerative TAECs are known as "travelling wave heat engines", characterised by a regenerator included in a travelling wave resonator. The value of the impedance at the location of the regenerator in a travelling wave resonator is relatively low, causing the influence of the flow resistance in the regenerator to be dominant. The efficiency is hereby adversely affected.

The present invention aims at increasing the capacity of a TAEC in a way wherein the efficiency loss observed in said exemplary embodiments does not or hardly take place and the net efficiency is much more favourable then in known TAECs.

SUMMARY OF THE INVENTION

The invention provides a TAEC, comprising an acoustic or acoustic-mechanical resonator circuit with included therein a regenerator with heat exchangers, in which the regenerator is provided with a bypass, formed by a (loss free) delay line or acoustic induction (inertia). It is known from, among others, documentation to which is referred hereafter (Ceperly), that for an optimum operation of the regenerator a real impedance has to reign herein, i.e. that the gas pressure (p) and the gas velocity (v) have to be substantially in phase with each other. Furthermore, the value of the impedance in the regenerator has to be high relative to the characteristic impedance of the medium, in order to limit the influence of the flow resistance. As will be appreciated, in a resonator the gas pressure (p) and the gas velocity (v) are circa 90 degrees out of phase.

By adding said bypass a pressure difference (dp) over the combination of bypass and regenerator comes about by lead time or induction (inertia), which is about 90 degrees out of phase with the original gas velocity (v) in the bypass or resonator respectively. The gas velocity in the regenerator is proportional to the pressure difference (dp) over said combination. Since in this way a phase shift of circa 90 degrees takes place twice, the net gas velocity in the regenerator is again almost in phase with the gas pressure (p) in the resonator, thus meeting the requirement of an almost real impedance.

For a bypass in which because of lead time or induction a phase shift $\phi$ takes place, this can be understood as follows: If we describe the pressure at the entrance of the bypass as $p_1=p.e^{j.\omega.t}$ then the pressure at the entrance of the bypass is $p_2=p.e^{j.(j.\omega.t-\phi)}$ The time average pressure difference over the bypass is thus equal to $$\Delta p=\bar{p}_1-\bar{p}_2=\bar{p}.(1-e^{-j.\phi})=\bar{p}.(1-\cos\phi-j.\sin\phi)$$

From this it shows that for small values of $\phi$ this pressure difference is circa 90 degrees out of phase with the gas velocity (v) in the bypass and resonator. Because the net gas velocity (v) in the regenerator is proportional to this pressure difference, the gas velocity in the regenerator will also be circa 90 degrees out of phase with the gas velocity in the resonator and thus in phase with the gas pressure in the resonator.

It shows that for small values of $\phi$ at the location of the regenerator an almost real impedance is created, the absolute value of the impedance in principle only being dependent on the value of the phase shift ($\phi$). By varying this phase shift by lead-time or induction in the bypass, the absolute value of the impedance in the regenerator can be varied over a large range and be set in such a way that the influence of the flow-resistance is no longer dominant and that both a high capacity and a high efficiency are obtained.

Since the delay line hardly adds any additional wall surface area to the total system and is not dissipative by nature, almost no additional losses are introduced. However, in practice always a parasitary flow resistance will come about. To minimise the influence of the former, the thickness of the viscous boundary layer (dv) has to be negligibly small compared to the diameter of the bypass. The thickness of this boundary layer (at atomsferic pressure) is given by the practical formula $d_1=\sqrt{2.1/freq}$ (in mm). In general that will be the case if the acoustic phase shift in the bypass is less than 45 degrees. A second requirement to minimise dissipation is to keep the gas velocity in the bypass low. In practice this means that the total cross-section of the bypass is in the order of 5% or more of the cross-section of the regenerator. In general the first requirement is herewith also amply met. There is in principle no upper limit for the cross-section of the bypass.

The length of the bypass is dependent on the desired phase shift ($\phi$) and can in principle have any value, depending on the implementation. To minimise losses, the bypass should be kept as short as possible.

The cross-section of the bypass does not need to be constant over the whole length. Acoustically this means that the bypass circuit can be built up from a combination of loss-free acoustic elements such as transmission lines (lead-time), self-inductions (inertia) and capacities (compliance).

Contrary to existing notions, as shown in the reference given hereafter, it is possible to choose the length of the heat exchangers much smaller then the amplitude of the gas extension. Hereby the flow losses are further minimised and a high efficiency is obtained in combination with the aforementioned measures. Furthermore, a first TAEC according to the described invention without membrane or bellows construction and E/M converter can be coupled to a second TAEC, thus realising a heat pumping system driven by heat with no moving part at all. Finally a first TEAC according to the described invention could be driven by pneumatic means (like a organ pipe) also realising a heat pumping system with no moving parts.

The invention will be explained hereafter in more detail with reference to some exemplary embodiments.

REFERENCES

Introductions:

Wheatly, J. et al, Understanding some simple phenomena in thermacoustics etc., Am.J.Phys. 53(2) Febr. '85, 147–162.

Ceperly, P.H., A pistonless Stirling engine—the travelling wave engine, J.Acoust.Soc.Am. 66(5) Nov. '79.

Patent literature:

U.S. Pat. No. 5,481,878

U.S. Pat. No. 5,522,223

EP 0678715

EXEMPLARY EMBODIMENTS

Figure 2:
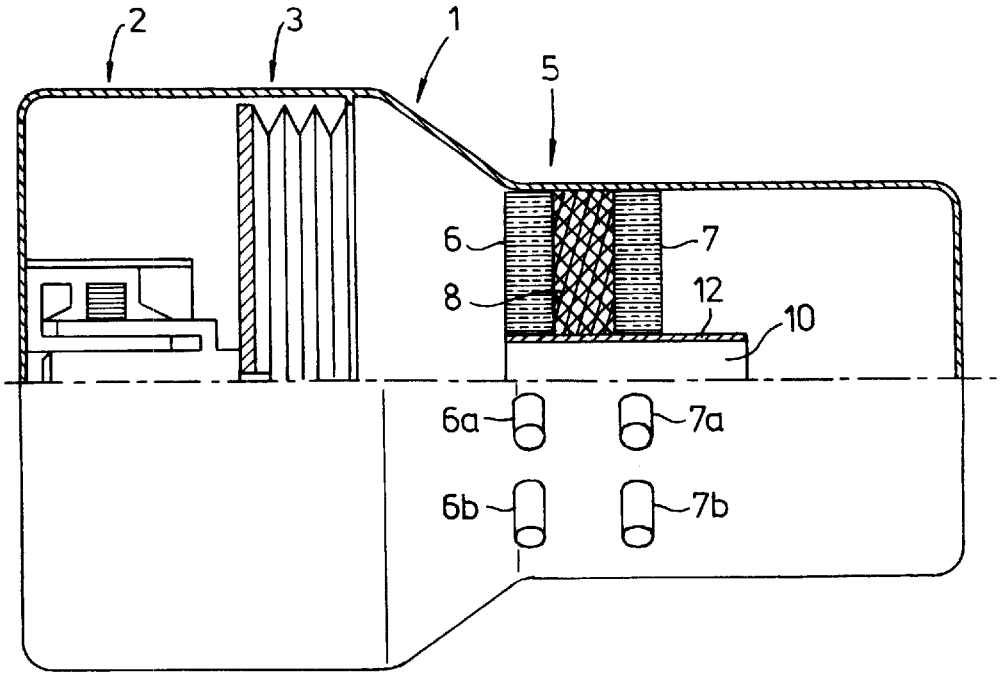
Figure 3:
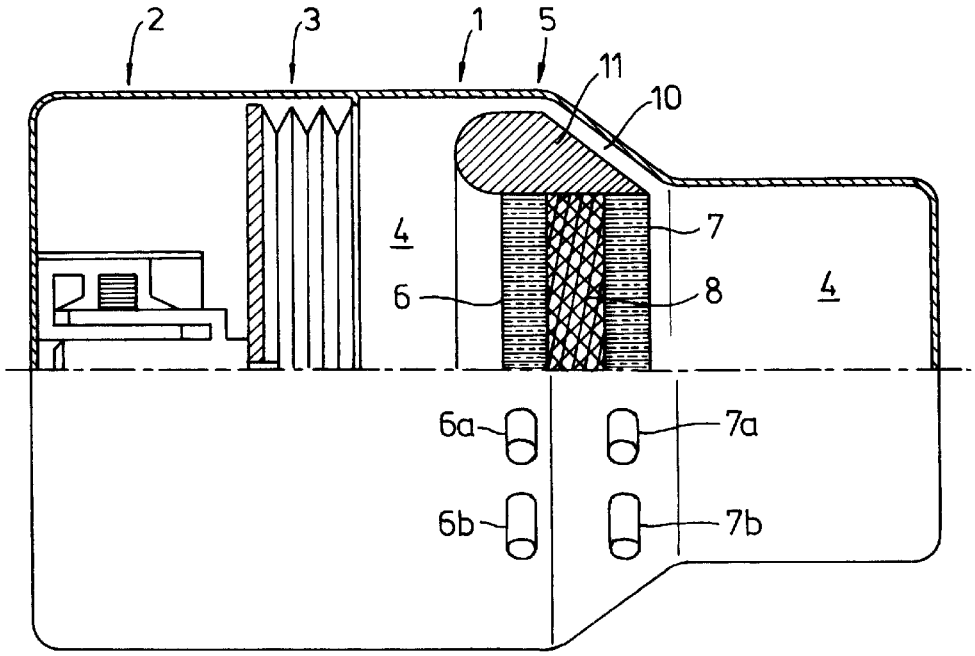

The FIGS. 1, 2 and 3 show an exemplary embodiment of a TAEC 1 according to the invention, including an E/M converter 2, viz. A linear electric engine or generator or pneumatic motor. The connection between 1 and 2 is formed by a membrane or bellows construction 3, which serves, apart from providing a gas tight sealing, also as necessary mass-spring-system. The TAEC 1 comprises further a resonance room or resonator 4, within which a regenerator 5 is located. The latter is formed by two heat exchangers, 6 and 7, with between them a regeneration body 8 of a gas permeable material, e.g. steel wool or metal foam. The heat exchangers 6 and 7 can be connected to external gas or liquid circuits by means of connections 6*a* and 6*b*, and 7*a* and 7*b* respectively, by which heat is supplied to or drained from the heat exchangers.

If the TAEC 1 is used as a heat pump, the E/M converter 2 is a linear electric or pneumatic (oscillation) engine, which makes the gas present in the resonator 4 through the membrane 3 to oscillate; heat exchanger 6 is the cold side, heat exchanger 7 is the hot side: thus heat is transported from heat exchanger 6, through the regeneration body 8, to heat exchanger 7. The TAEC can thus serve for refrigeration or heating. In both cases heat is drained from a first medium, by means of a condenser connected to the "cold" heat exchanger 6, and this heat is given to a second medium via heat exchanger 6, regenerator body 8, "hot" heat exchanger 7 and a radiator connected thereto; thus heat transport takes place from the first medium to the second medium.

If the TAEC 1 is used as an engine, heat exchanger 6 is connected to a circuit with a heated medium, while heat exchanger 7 is connected to a refrigerating circuit. The gas present in the resonator 4 comes into resonance (oscillation), which is kept up by heat supply via heat exchanger 6 and heat drain via heat exchanger 7. By the gas oscillation, also the membrane 3 starts to oscillate and that oscillation is passed on to the E/M converter, which now functions as a generator, and converted into electrical power.

It should be noted that the resonator in the TAEC, in stead as a standing wave resonator, also can be implemented as a Helmholtz resonator. In the TAEC 1 according to the invention the resonator room 4 is provided with a bypass 10 over the regenerator. The FIGS. 1, 2 and 3 show different constructive embodiments of the bypass 10. In FIG. 1 the bypass (shunt) is formed "straight" by a number of external connection channels, which connect the one part of the resonance room 4 with the other part; the length of the connection channels determines the lead-time. In FIG. 2 the bypass 10 is formed by a internal connection tube 12 through a bore in the heat exchangers 6 and 7 and the regeneration body 8; the length of the connection tube determines the lead-time. The bypass 10 in the embodiment of FIG. 3 is annularly shaped and is formed by the outer mantle of the resonance room 4 and the outside of a spacer ring 11, which envelopes the heat exchangers 6 and 7 and the regenerator body 8. By the shape shown a "delay line" is created, of which—and that also applies to the embodiments of the FIGS. 1 and 2—the lead time is so large that the pressure difference over the combination of bypass and regenerator differs circa 90 degrees in phase with the gas velocity in the resonator. By this measure is achieved that the TAEC gets a real impedance at the location of the regenerator, the value of which depending on the lead-time of the delay line, thus increasing the capacity. The efficiency does not drop, since the delay line hardly adds any wall surface area to the total system and is not dissipative, not causing any additional losses to be introduced. To minimise the influence of the parasitary flow resistance, the thickness of the viscous boundary layer (dv) has to be negligibly small relative to the diameter of the bypass. To minimise the dissipation the gas velocity in the bypass has to be kept low. In practice this means that the total cross-section of the bypass is in the order of 5% or more of the cross-section of the regenerator. The length of the bypass, determined by the shape of the spacer ring 11, is preferably smaller than 5% of the wavelength. The cross-section of the bypass does not need to be constant over the whole length. Acoustically, this means that the bypass circuit can be built up from a combination of acoustic elements, such as transmission lines (lead-time), self-inductions (inertia) and capacities (compliance). The cross-section of the bypass can be easily set in the embodiment shown in FIG. 3 by axially shifting the spacer ring.

Figure 4:
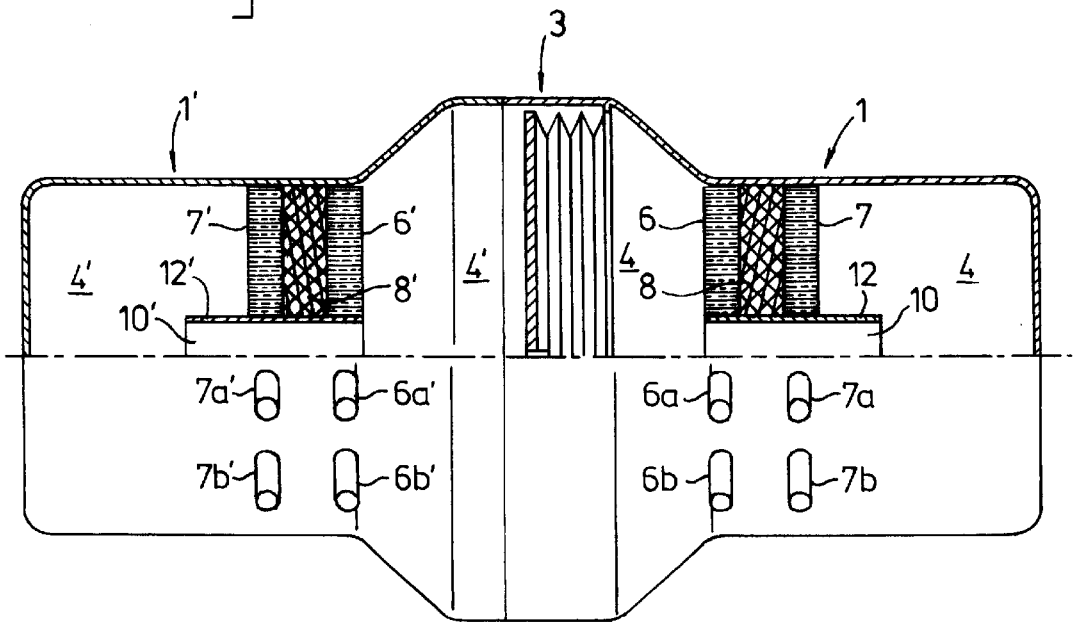

Finally, FIG. 4 shows a combination of two identical TAECs, one of which operating as an engine and one as a heat pump. The resonators of both TAECs can be coupled to each other without membrane via a narrow tube forming a Helmholz resonator, or, like FIG. 4 shows, via a common membrane (which provides mass inertia). The TAEC 1 left in the Figure is used as an engine. To this end the heat exchanger 6 is connected to a circuit with a heated medium, while heat exchanger 7 is connected to a refrigerating circuit. The gas present in the resonator 4 comes into resonance (oscillation), which is kept up by heat supply via heat exchanger 6 and heat drain via heat exchanger 7. By the gas oscillation the membrane 3 starts to oscillate and that oscillation is passed on to the resonator 4 of the right TAEC 1. TAEC 1 is used as a heat pump, of which, via the membrane 3, the gas present in resonator 4 is brought into oscillation. Heat exchanger 6 is the cold side of the heat pump, heat exchanger 7 is the hot side: thus, heat is transported from heat exchanger 6, via the regeneration body 8, to heat exchanger 7. In this way, TAEC 2 serves for refrigeration or heating, driven by TAEC 1.

What is claimed is:

1. A thermo-acoustic energy converter, comprising:

a acoustic resonator room filled with a gas, the gas creating a gas pressure in the room;

a regenerator assembly within the acoustic resonator room, the regenerator assembly comprising a regenerator, a cold heat exchanger arranged adjacent a first side of the regenerator, and a warm heat exchanger arranged adjacent a second side of the regenerator; and a non-dissipative bypass circuit filled with the gas, the non-dissipative bypass circuit connecting one side of the regenerator assembly with another side of the regenerator assembly, the non-dissipative bypass circuit arranged to use an acoustic propagation delay or an inertance of the gas to create in the regenerator a gas velocity in phase with the gas pressure of the acoustic resonator room.

2. The energy converter of claim 1, wherein, the bypass circuit has an acoustic phase shift within 45 degrees of the gas pressure of the acoustic resonator room.

3. The energy converter of claim 1, wherein, a cross-section of the bypass circuit is at least 5% of a cross-section of the regenerator.

4. The energy converter of claim 1, wherein, a length of either of the cold heat exchanger and the hot heat exchanger is less than a length of a local extension of an amplitude of a wavelength of the gas.

5. A thermo-acoustic system, comprising:

a first acoustic resonator room filled with a gas, the gas creating a gas pressure in the first room;

a first regenerator assembly within the first acoustic resonator room, the regenerator assembly comprising:

a first thermo-acoustic energy converter having a first regenerator, and two heat exchangers, a cold heat exchanger arranged adjacent a first side of the first regenerator, and a warm heat exchanger arranged adjacent a second side of the first regenerator;

a non-dissipative bypass circuit filled with the gas, the non-dissipative bypass circuit connecting one side of the first regenerator assembly with another side of the first regenerator assembly, the non-dissipative bypass circuit arranged to use an acoustic propagation delay or an inertance of the gas to create in the first regenerator a gas velocity in phase with the gas pressure of the first acoustic resonator room; and a second thermo-energy converter having a second resonator room with a second regenerator assembly, the second resonator room coupled to the first resonator room, the second thermo-energy converter being essentially identical to the first thermo-energy converter, the first thermo-energy converter being arranged to supply heat to one of the first converter's two heat exchangers and drain heat from the other of the first converter's two heat exchangers, and the second thermo-energy converter being arranged as a heat pump driven by the first thermo-energy converter so that heat from one of the second converter's two heat exchangers is pumped into the other of the second converter's two heat exchangers.

6. The system of claim 5, further comprising:

a linear electric or pneumatic motor connected to and driving the resonator of the first converter.

7. The system of claim 5, further comprising:

a non-linear pneumatic mechanism connected to and driving the resonator of the first converter.

8. The system of claim 7, wherein said non-linear mechanism is a organ pipe.

* * * * *